US006503025B1

(12) United States Patent
Miller

(10) Patent No.: US 6,503,025 B1
(45) Date of Patent: Jan. 7, 2003

(54) PRECAST CONCRETE BEAM ELEMENT AND METHODS OF MAKING AND INSTALLING SAME

(76) Inventor: Philip Glen Miller, P.O. Box 6030, Lake Charles, LA (US) 70606

( * ) Notice: Subject to any disclaimer, the term of this patent is extended or adjusted under 35 U.S.C. 154(b) by 0 days.

(21) Appl. No.: 09/634,596

(22) Filed: Aug. 8, 2000

Related U.S. Application Data

(60) Provisional application No. 60/175,428, filed on Jan. 11, 2000.

(51) Int. Cl.[7] ..... E02D 5/00; E02D 5/66; B28B 7/02

(52) U.S. Cl. ..... 405/231; 405/233; 405/243; 405/257; 249/155

(58) Field of Search ..... 405/229, 230–233, 405/243, 244, 256, 284, 286, 257; 52/596, 608; 249/1, 20, 48, 50, 155, 158

(56) References Cited

U.S. PATENT DOCUMENTS 1,320,720 A * 11/1919 Tomlinson ..... 405/229
1,999,783 A * 4/1935 Riesbol ..... 249/29
4,081,969 A * 4/1978 Clarke ..... 405/286
5,263,798 A * 11/1993 Dupeuble et al. ..... 405/284 X
6,231,272 B1 * 5/2001 Bishop ..... 405/286

* cited by examiner

*Primary Examiner*—Thomas B. Will
*Assistant Examiner*—Tara L. Mayo
(74) *Attorney, Agent, or Firm*—Patton Boggs LLP

(57) ABSTRACT

A precast concrete beam element, used as a continuous bearing structural foundation member supporting wall and floor slab loads in soil, includes a bearing surface for spreading vertical loads into the soil and a wall section having a height sufficient to place the bearing surface at a specified bearing depth in the soil. The precast beam element also includes a formed-in notch to serve as a block ledge to facilitate weathertight wall installation. The beam element is manufactured offsite in a mold capable of changing dimension to cast elements with differing bearing heights and differing wall thicknesses as soil and loading conditions require.

18 Claims, 5 Drawing Sheets

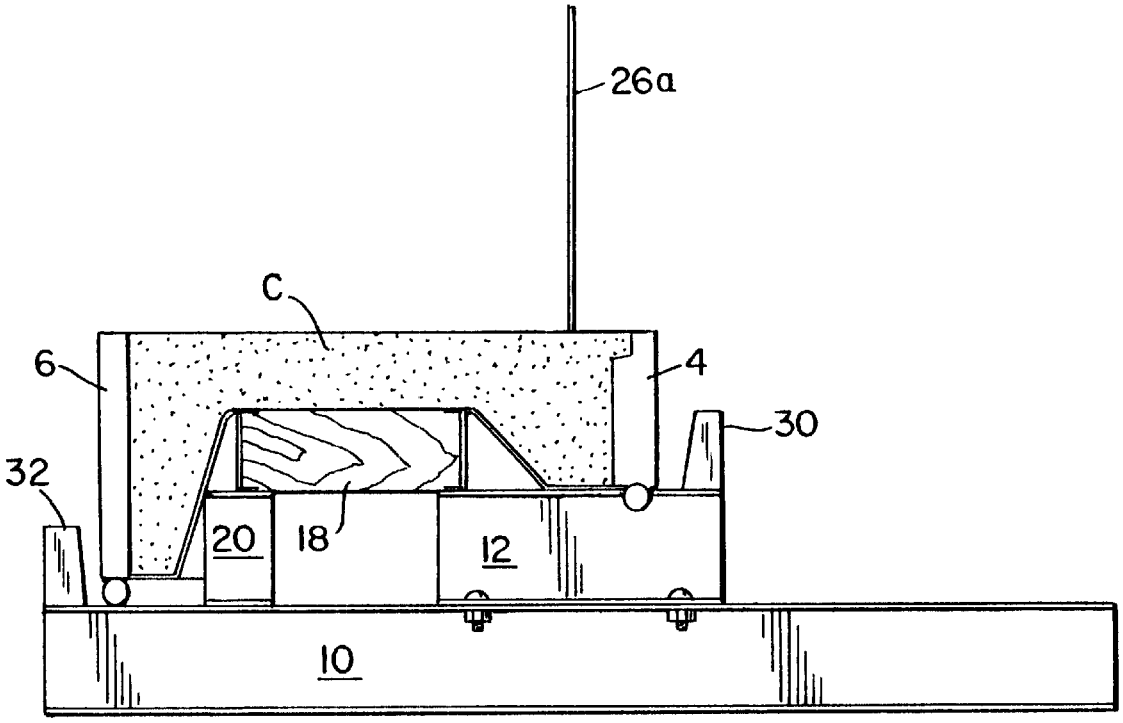
Fig.3a
Fig.3b
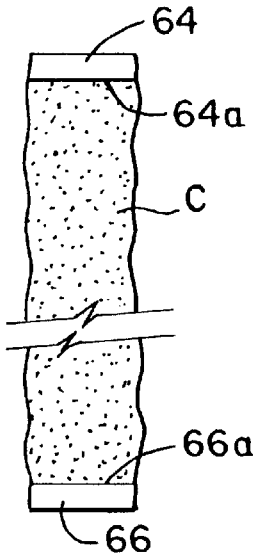

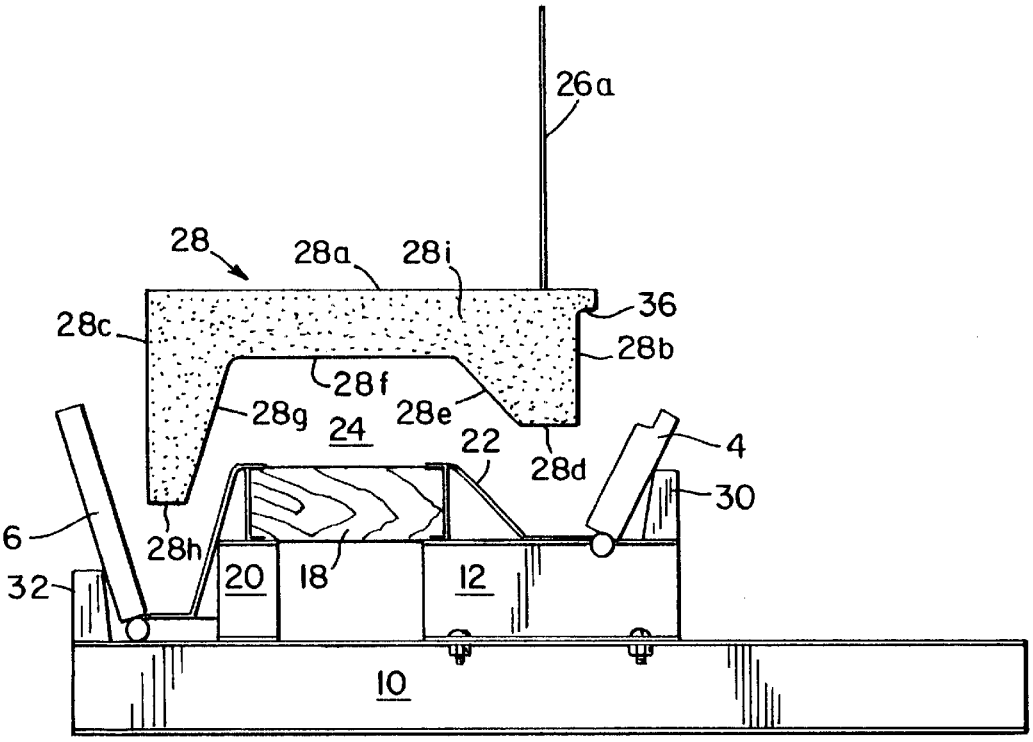
Fig.4
Fig.5
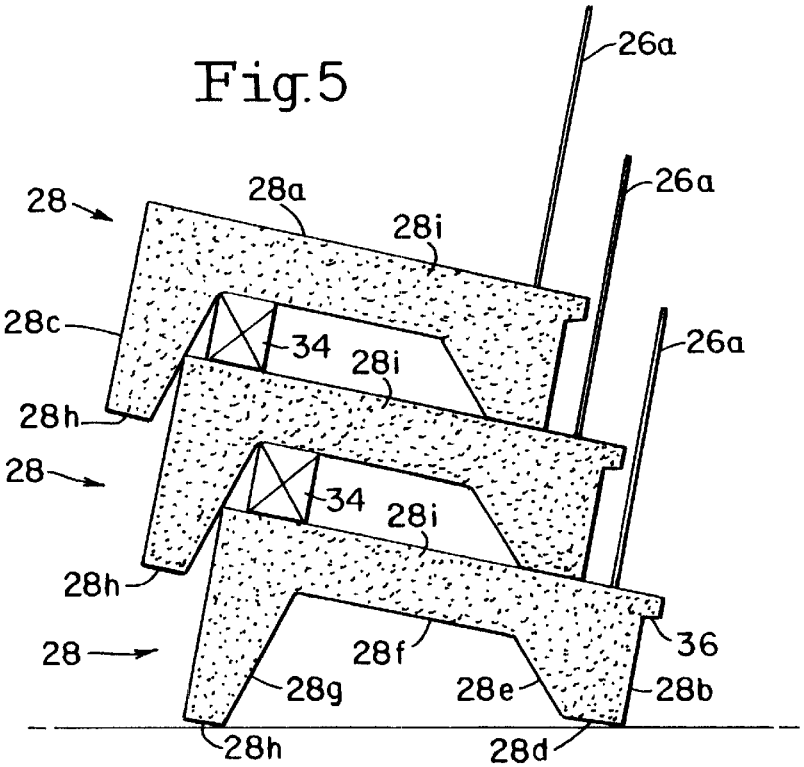

PRECAST CONCRETE BEAM ELEMENT AND METHODS OF MAKING AND INSTALLING SAME

This is a regular application based on U.S. Provisional Application No. 60/175,428, which was filed on Jan. 11, 2000.

BACKGROUND OF THE INVENTION

This invention relates to a precast concrete structural element and to methods of making and installing same. More particularly, this invention relates to a precast concrete beam element for providing continuous footing support in building and structure foundations and to methods of making the precast element and installing it in building and structure foundations.

Several methods for providing continuous beam footing for wall and floor slab support in building and structural foundations are known in the art. Three of the most popular methods are described below.

One popular method involves excavating a trench, placing edge forms and reinforcement in the trench, and either partially casting the beam and then casting the floor slab or simultaneously casting the beam and floor slab. This method has several disadvantages. For example, the method requires an excavation that is open to weather conditions while reinforcement is being placed in the trench. This often necessitates removal of the reinforcement after inclement weather has passed in order to remove mud and water from the excavation and restore bearing capacity prior to casting. In addition, this method requires field forming of the floor slab edge and the wall ledge. Thus, the accuracy of the slab edge forming, the wall ledge forming and the beam shape are each dependent on the skill of the craftsmen executing the work in the field. Furthermore, the method uses more concrete that would be required simply for structural purposes in order to save the cost of forming a thinner wall thickness that is required structurally. This increase in sectional area of the concrete necessitates an increase in the amount of steel reinforcement required under some building codes. Also, the increase in the bearing width requires additional unnecessary concrete in the upper section of the beam.

A second popular method for providing continuous beam footing to support wall and floor slab edges involves excavating a trench, casting the continuous bearing beam in the trench, forming an upper stem wall section including a support notch for a floor slab, casting the stem wall section, removing the forms, backfilling void areas adjacent to the stem wall, and then casting the floor slab.

This second method offers some advantages over the first method discussed above in that, in the second method, the upper stem wall can be formed to the minimum thickness required for structural needs, thereby saving substantial concrete material if the bearing depth is significant. The second method also allows for a greater difference between finish floor height and the ultimate exterior grade. However, the second method also has several disadvantages. For example, it requires an excavation open to weather conditions as in the first method but in the second method the excavation is open for an even longer period while the stem wall section is formed. The second method requires labor-intensive forming of the stem wall section, often in below grade conditions which may require continuous dewatering to achieve a structurally sound installation. The second method further requires subsequent backfilling and compaction of the void areas adjacent to the stem wall. Moreover, the second method requires either a notch to support the floor slab or steel rods through the inner face form to provide shear dowels into the floor slab. In addition, the accuracy of the slab edge forming, the slab bearing notch, and the stem wall section are each dependent on the skill of the craftsmen executing the work in the field.

A third popular method for providing continuous beam footing to support wall and floor slab edges is similar to the second method discussed above, except that in the third method, the exterior walls (usually masonry) are extended to the top of the bearing beam, followed by floor casting. In an advantage over the second method, the third method eliminates the stem wall forming step. However, the third method requires an extended period of open excavation and, typically, the time required for the installation of the below-grade portion of the exterior wall is even longer than that required to form the stem wall in the second method. Furthermore, installation of the below-grade portion of the exterior wall is labor intensive. In a further disadvantage, the third method requires backfilling and compaction of the void areas adjacent to the below-grade portion of the exterior wall. In addition, accuracy is still dependent upon the skill of the craftsmen executing the work in the field.

A primary object of this invention is to provide an improved concrete beam element which integrates the edge of slab form and the wall ledge to completely eliminate the need for field forming.

Another object of this invention is to provide an improved concrete beam element which is capable of being cast with dowel rods projecting above the wet concrete instead of through the mold.

A further object of this invention is to provide an improved method of making a concrete beam element which does not require field forming.

A still further object of this invention is to provide an improved method of making a concrete beam element wherein the method uses a mold that allows for varying beam heights to accommodate varying beam depths.

Another object of this invention is to provide an improved method of making a concrete beam element wherein the method uses a mold the depth of which can be easily increased to offer additional bearing capacity or stem wall thickness as soil and loading conditions require.

Yet another object of this invention is to provide an improved method of installing a concrete beam element wherein the exposure period of the excavation site to the weather is significantly less than that required in the prior art methods discussed hereinabove.

These objects and others are achieved in the present invention.

DETAILED DESCRIPTION

One embodiment of the present invention provides a precast concrete beam element for use as a continuous bearing structural foundation member supporting wall and floor slab loads in soil. Another embodiment of the present invention provides a method of making the aforementioned precast structural beam element. In addition, a further embodiment of the present invention provides a method for installing the precast concrete beam element into a building or structural foundation.

The precast structural beam element may include a straight back face, a top surface, a bottom surface, a front face, and first and second opposite side faces disposed between the back and front faces and between the top and bottom surfaces. The front face may include: a first upper surface extending perpendicularly and downwardly from the top surface and being parallel to the back face; a second upper surface which slopes downwardly and inwardly from the first upper surface; a middle surface which is parallel to the back face and which extends downwardly from the second upper surface; a first lower surface which slopes downwardly and outwardly from the middle surface; and a second lower surface which is parallel to the back face and which extends downwardly from the first lower surface and perpendicularly to the bottom surface. The beam element may include a notch formed therein which extends lengthwise along the top surface, and/or the middle surface of the front face has a dapped surface formed therein.

The method of making the beam element may include providing a mold containing: (a) a longitudinally movable lateral side rail having an inner wall for forming the top surface of the beam element; (b) an opposite fixed lateral side rail having an inner wall for forming the bottom surface of the beam element; (c) a first longitudinal side rail disposed between the movable and fixed lateral side rails and having an inner wall for forming the first side face of the beam element; (d) an opposite second longitudinal side rail disposed between the movable and fixed lateral side rails and having an inner wall for forming the second side face of the beam element; (e) an infill plate disposed between the inner walls of the lateral and longitudinal side rails such that an upper face of the infill plate and the inner walls of the lateral and longitudinal side rails define a mold cavity, the upper face of the infill plate being disposed to form the front face of the beam element; and (f) one or more dowel rods projecting upwardly from the mold cavity. The method may also include: filling the mold cavity with a flowable fill material; allowing the flowable fill material to harden to form the beam element; and removing the beam element from the mold cavity.

The method of installing the beam element may include: providing an excavated trench having a bottom surface, inner wall surfaces and an open top surface; (2) suspending the beam element above the trench so that a bottom gap is formed between the bottom face of the beam element and the bottom surface of the trench and a side gap is formed between the inner walls of the trench and the front, back and side faces of the beam element; (3) pouring a flowable fill material into the trench so as to fill the bottom gap and at least a portion of the side gap; and (4) causing the poured material to harden.

Another embodiment of the present invention provides a method for forming a floor slab. The method may include: (1) installing the beam element in accordance with the method above; (2) providing a floor slab-forming location for forming the floor slab, the location being adjacent to the beam element such that the back face of the beam element will serve as an edge form during casting of the floor slab; and (3) casting the floor slab in the location.

A further embodiment of the present invention provides a method of forming a wall slab. The method may include: (1) installing the beam element in accordance with the method above; (2) providing a wall slab-forming location for forming the wall slab, the location being adjacent to the beam element such that the top face of the beam element will serve as an edge form during casting of the wall slab; and (3) casting the wall slab in the location.

The precast concrete beam element may include a unique shape and a bearing surface (defined by the bottom surface of the beam element) for spreading vertical loads into soil and a wall section (defined by the back face of the beam element) having a height sufficient to place the bearing surface at a specified bearing depth in the soil. The precast beam element may also include a formed-in notch to serve as a block ledge to facilitate weathertight wall installation. The beam element may integrate both the slab form edge and the wall ledge, for example, to eliminate the need for field forming.

The precast concrete beam element may be manufactured offsite in a mold capable of changing dimension to cast elements with differing bearing heights. The unique shape of the beam element allows it to be cast with dowel rods projecting above the wet concrete instead of through the mold. In addition to offering adjustable beam height for varying beam depths, the mold depth can be easily increased to offer additional bearing capacity or stem wall thickness as soil and loading conditions require.

The method of installing the precast concrete beam element may involve the simple suspension of the beam element above an excavated trench with a gap being formed between the bottom and sides of the trench and the surfaces of the beam element. As the beam element is suspended above the trench, a flowable fill material is poured into the trench to fill the void areas. When the flowable fill material hardens, the beam element is locked into place, achieving full bearing and lateral stability.

The embodiments of the present invention offer advantages over the prior art. For example, the beam element may be made using an adjustable mold which provides the ability to manufacture beam elements with varying structural capacities. In addition, the particular cross-section of the beam element may provide structural capacity with minimal material and weight. Furthermore, such cross-section may also allow for efficient stacking of the beam elements in the storage yard and may facilitate easy handling for loading and trucking.

Another advantage is that the beam element may be capable of serving as a stayin-place form for the slab edge and the wall ledge. Moreover, the construction site may be prepared while the beam elements are being produced offsite. This facilitates rapid installation of the elements as soon as the site preparation is complete. Furthermore, the flowable fill material may be cast as the beam elements are being installed, thereby greatly reducing the exposure time of the excavation site to inclement weather.

No edge forming of the slab, wall ledge or field forming of the stem wall may be required in making the beam element.

Installation accuracy is assured, for example, since the installation worker can adjust the beam location using an adjustable hanger. The beam element may be grouted and secured into place before the slab is cast, thereby assuring that the edge will not vary as field forms tend to do under the pressure of concrete casting.

Also, the use of special forms to make the beam elements eliminates dependency on skilled labor to assure accurate beam and slab edge dimensions.

BRIEF DESCRIPTION OF THE DRAWINGS

FIG. 3*a* is a schematic illustration, and FIG. 3*b* is a top view illustration, of the mold shown in FIG. 1, wherein the mold is filled with concrete.

FIG. 4 is a schematic illustration of a beam element of this invention formed from the mold shown in FIGS. 1–3, wherein the beam element is being removed from the mold.

FIG. 5 is a schematic illustration of a stack of the invention beam elements for storage and shipping.

Figure 1:
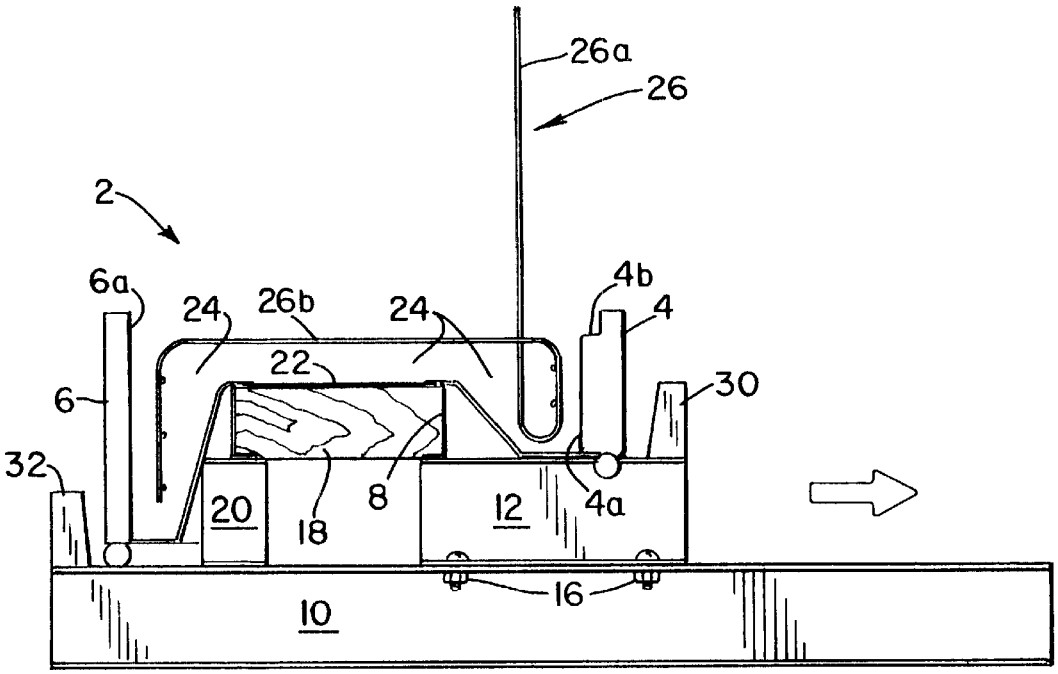
FIG. 1 is a schematic illustration of a longitudinal side view of a mold which can be used to form the beam element of this invention.
Figure 2:
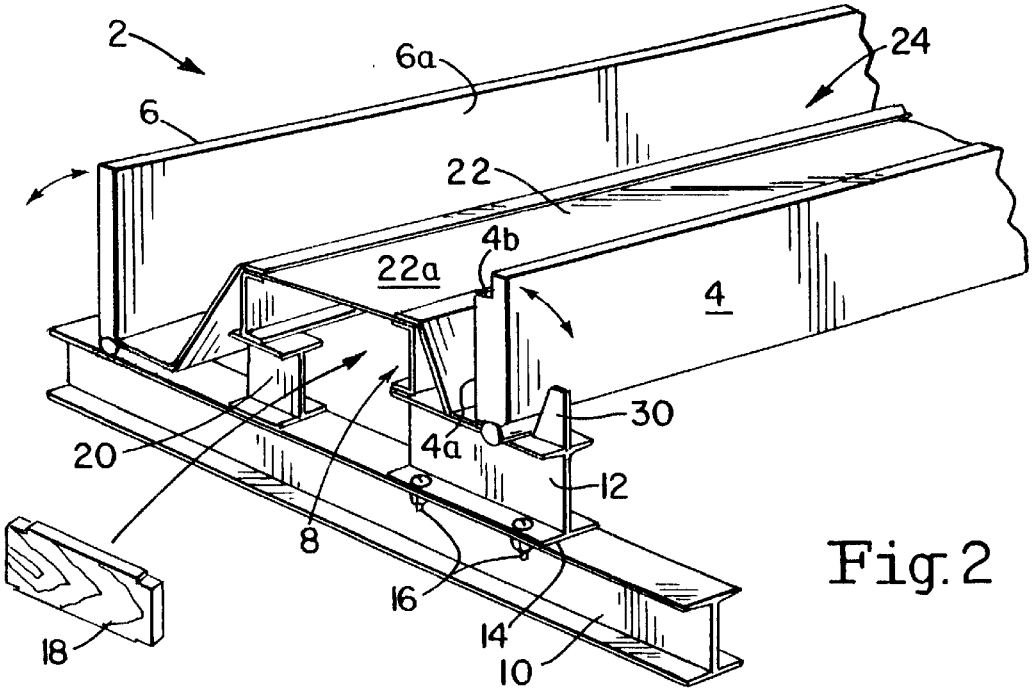
FIG. 2 is a schematic illustration of a perspective view of the mold shown in FIG. 1.

The precast concrete beam element of this invention, its method of manufacture and its method of installation will be described with reference to FIGS. 1–9 herein.

The precast concrete beam element of this invention is manufactured in a mold capable of changing dimension to cast elements with differing bearing depths and structural capacities. Such a mold is represented by reference numeral 2 in FIGS. 1–4.

Mold 2 includes a movable lateral side rail 4, a fixed lateral side rail 6, and first and second longitudinal side rails 64, 66 (see FIGS. 3*a* and 3*b*). Movable lateral side rail 4 has an inner wall 4*a,* an upper portion of which preferably contains a notch 4*b.* Notch 4*b* is used to form a notch 36 in the concrete beam element (see FIGS. 4–9). Fixed lateral side rail 6 has an inner wall 6*a*. A channel 8 is defined between the inner walls 4*a,* 6*a* of the lateral side rails, the inner walls 64*a,* 66*a* of the longitudinal side rails and the upper face of a support member 10.

Movable lateral side rail 4 rests on a movable side rail base member 12 which in turn rests on support member 10. Fixed lateral side rail 6 also rests on support member 10.

Side rail base member 12 is longitudinally movable in the direction shown. In the embodiment shown in FIG. 2, side rail base member 12 and support member 10 each contain through-holes (not shown) and are attached to one another at a contact point 14 by aligning the respective through-holes in the base member and the support member and then placing screws 16 placed in the through-holes. In such embodiment, the base member 12 can be moved by removing the screws and moving the base member to a second contact point (not shown) located either on support member 10 or on a subsequent support member (not shown). At the second contact point, the support member will contain through-holes (not shown), which are aligned with the through-holes disposed in the side rail base member. Screws 16 are then placed through the aligned through-holes, thereby securing the side rail base member 12 to the support member at a second contact point.

Mold 2 preferably further includes a number of support blocks 18 (preferably one support block every four feet), preferably made of wood, which is placed in channel 8. Blocks 18 inturn each preferably rest on a second support block 20. An infill plate 22 (preferably made of steel), the upper face of which defines the front face of the beam element to be formed, is placed in channel 8 over support blocks 18. The upper face 22*a* of plate 22, inner walls 4*a,* 6*a* of the lateral rails 4, 6, and the inner walls (not shown) of the longitudinal side rails define a mold cavity 24. Upper face 22*a* of plate 22 forms the front face of the beam element to be formed, the inner wall 4a of side rail 4 forms the top face of the beam element, the inner wall 6*a* of side rail 6 forms the bottom surface of the beam element, and the upper edge of mold cavity 24 forms the straight back face of the beam element. The inner walls of the longitudinal side rails (not shown) form the side faces of the beam element.

The height of the beam element to be formed can be increased by moving side rail 4, via side rail base member 12, longitudinally in the direction shown, as discussed hereinabove.

Projecting within and vertically upwardly from mold cavity 24 are one or more dowel rods 26. Dowel rod(s) has an upstanding portion 26*a* and an embedded portion 26*b* which is embedded in the concrete beam element to be formed.

FIG. 3 shows mold cavity 24 filled with concrete C to effect casting of the beam element of this invention. An advantage of the present invention is that the dowel rod(s) 26 is positioned in the mold cavity when the wet concrete is poured therein. Thus, the dowel rod portion 26*a* projects above the wet concrete instead of through the mold. This allows steel rods to project above the surface of the formed concrete beam element to dowel into the floor slab without requiring a penetration of the mold.

After the concrete C has hardened in mold cavity 24, the resulting beam element 28 is removed from mold 2. As shown in FIG. 4, the beam element 28 can be removed from the mold by pivoting lateral side rails 4 and 6 outwardly (m the direction of the arrows shown in FIG. 2) until the rails rest on rail-stopping members 30 and 32, respectively, and by pivoting longitudinal side rails (not shown) in the same manner.

As can be seen in FIG. 4, dowel rod portion 26*a* protrudes upwardly from the formed beam element 28.

During storage and shipping, a plurality of beam elements 28 can be stacked as shown in FIG. 5, with spacers 34 disposed between adjacent beam elements.

The beam element of this invention preferably has the shape shown in FIGS. 4-9 herein.

As shown in FIGS. 4–9, beam element 28 includes a straight back face 28*a,* a top surface 28*b,* a bottom surface 28*c,* a shaped front face defined by surfaces 28*d,* 28*e,* 28*f,* 28*g* and 28*h,* and side faces 28*i* Back face 28*a* and side faces 28*i* are designed to extend vertically relative to the ground G when the beam element is installed. Top surface 28*b* is straight except for a notch 36 preferably formed therein which extends lengthwise along top surface 28*b* (see FIG. 9). Notch 36 serves as a block ledge during the casting of the floor slab and can facilitate weathertight wall installation. Top surface 28*b* is intended to extend horizontally relative to the ground G when the beam element is installed. Bottom surface 28*c* is also straight and is designed to extend horizontally relative to the ground G when the beam element is installed.

Beam element 28 is composed of (i) a first or upper flange defined by an upper portion of back face 28*a,* top surface 28*b,* front-face surfaces 28*d* and 28*e;* and upper portions of side faces 28*i;* (ii) a middle section defined by a middle portion of back face 28*a,* front-face surface 28*f* and dapped surface 38 (see FIG. 9) and middle portions of the side faces 28*i;* and (iii) a second or lower flange defined by a lower portion of back face 28*a,* front-face surfaces 28*g* and 28*h,* bottom face 28*c,* and lower portions of side faces 28*i.* Surface 28*d* of the upper flange is straight and parallel to the back face 28*a* of the beam element. Surface 28*e* of the upper flange slopes inwardly and downwardly from surface 28*d* toward the middle of the beam element. Surface 28*f* is straight and parallel to back face 28*a* of the beam element. Surface 28*g* of the lower flange extends outwardly and downwardly from surface 28*f.* Surface 28*h* of the lower flange is straight and parallel to back face 28*a* of the beam element. Dapped surface 38, which has a Z shape, is used to align the plurality of beam elements during installation.

Installation of the beam elements of this invention can be understood by reference to FIGS. 6–9.

Figure 6:
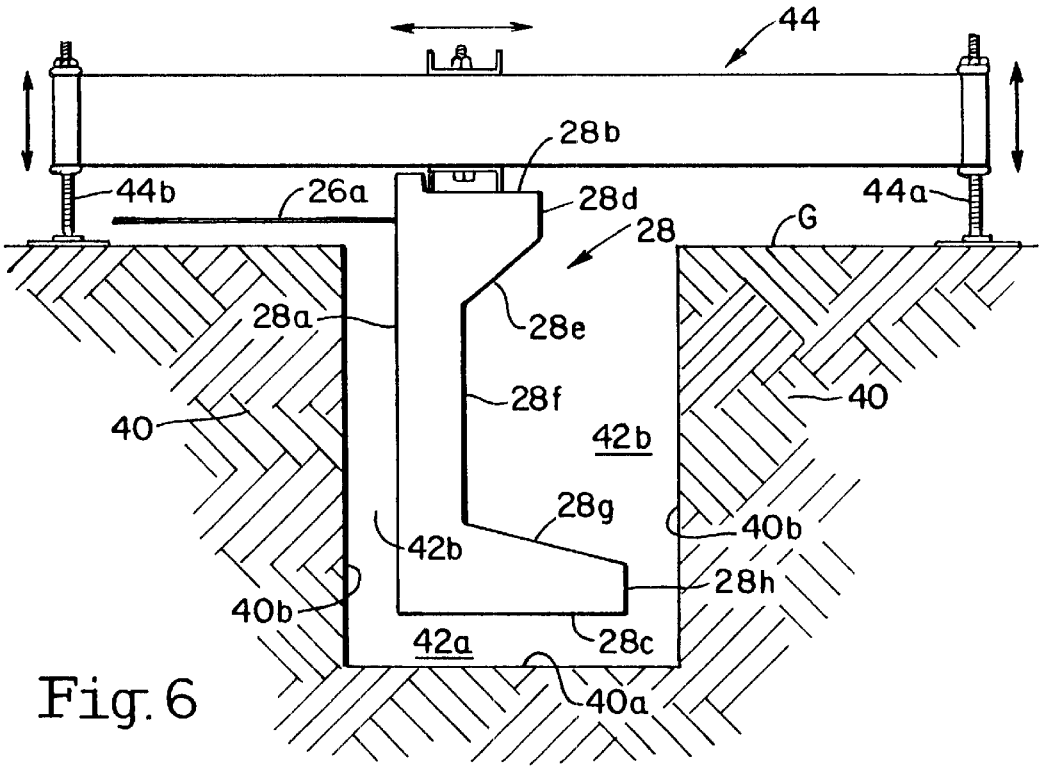
FIG. 6 is a schematic illustration of a beam element of the present invention being suspended over a trench in accordance with the installation method of this invention.

As shown in FIG. 6, precast beam element 28 is suspended above an excavated trench 40 having a bottom surface 40*a* and side walls 40*b.* The beam element is suspended above trench 40 in such a way as to leave a gap or void area 42*a* between the bottom face of the beam element and the bottom surface of the trench; and a gap or void area 42*b* between the front, back and side faces of the beam element and the inner walls of trench 40. The particular depth and width of the trench will vary according to the structural requirements for individual buildings and foundation conditions.

Beam element 28 is suspended by bearing the first or upper flange (defined by surfaces 28*b,* 28*d* and 28*e* and a portion of back face 28*a*) of the beam element on the dapped end (not shown) of a previously installed beam element (not shown), thereby aligning beam element 28 with the previous beam element. The second or lower flange (defined by surfaces 28*g,* 28*h,* 28*c* aid a portion of back face 28*a*) of beam element 28 is supported by a special adjustable suspension hanger 44 that is fully adjustable in the directions shown (i.e., vertically and horizontally) and torsionally. First and second end members 44*a* and 44*b* of the hanger rest on the ground G as shown in FIG. 6.

Figure 7:
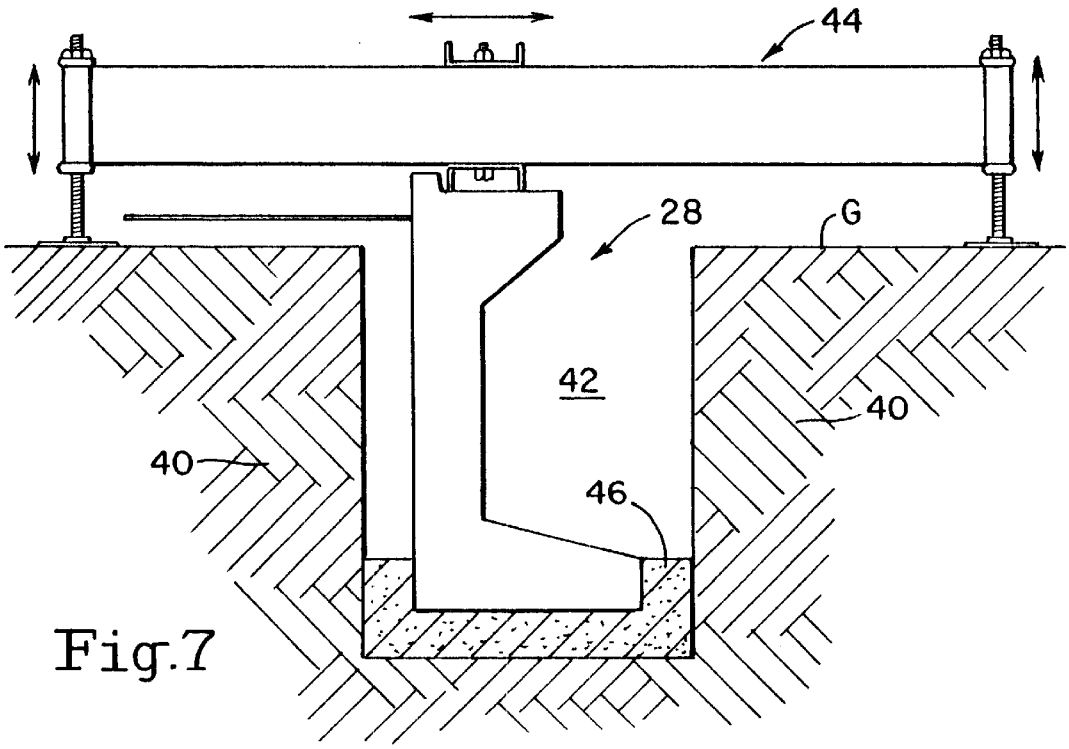
FIG. 7 is a schematic illustration of the grouting step of the installation method of this invention using the beam element and trench shown in FIG. 6.

As can be seen in FIG. 7, as beam element 28 is suspended above trench 40, a flowable fill material 46 (e.g., grout or wet concrete) is poured into the trench to fill gap 42*a* and at least a portion of gap 42*b.* As used herein, the term "pouring" is intended to include a pumping operation.

When material 46 hardens, the beam element 28 is locked into place, achieving full bearing and lateral stability. To reduce the required flowable fill volume to the minimum required for structural support, the remainder of gap 42*b* can be filled with inexpensive granular fill 48 (e.g., sand) and backfilled soil 50, as shown in FIG. 8.

Since the flowable fill material 46 is capable of transferring load in a diagonal shear cone, the effective bearing area can be the fill width of trench 40 if the portion of gap 42*a* below the bottom face 28*c* of beam element 28 is equal to the portion of gap 42*b* between the trench inner walls 40*b* and the front, back and side surfaces of beam element 28. By increasing the depth and width of the trench, the bearing area can effectively be increased without enlarging the beam element. As discussed hereinabove, the beam element of this invention can also be expanded in width, stem wall thickness and depth so that a wide variety of loading and soil conditions can be accommodated.

Figure 8:
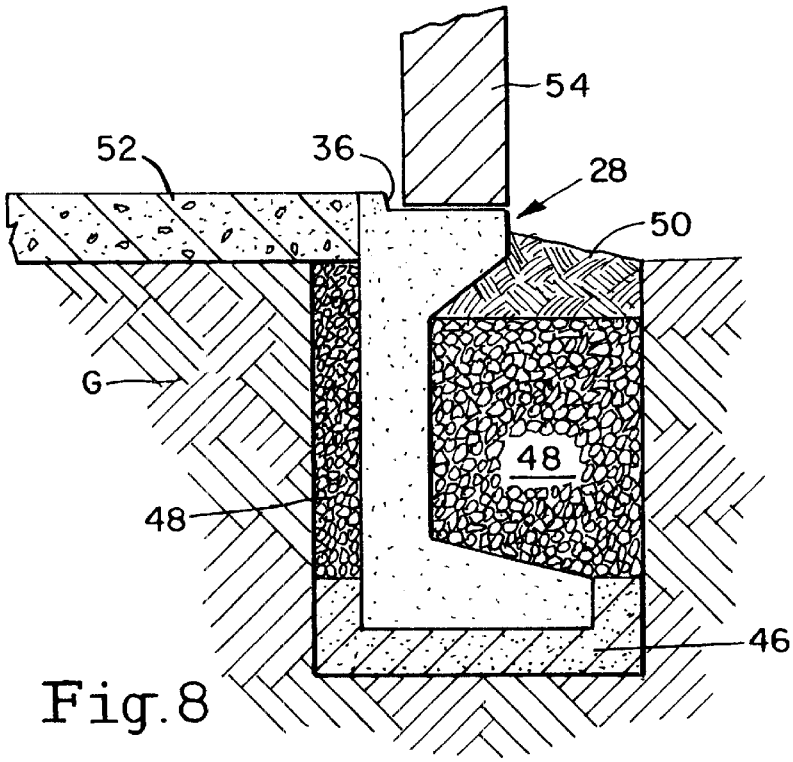
FIG. 8 is a schematic illustration of the slab-pouring step of the installation method of this invention, using the beam element, trench and grouting material shown in FIG. 7.
Figure 9:
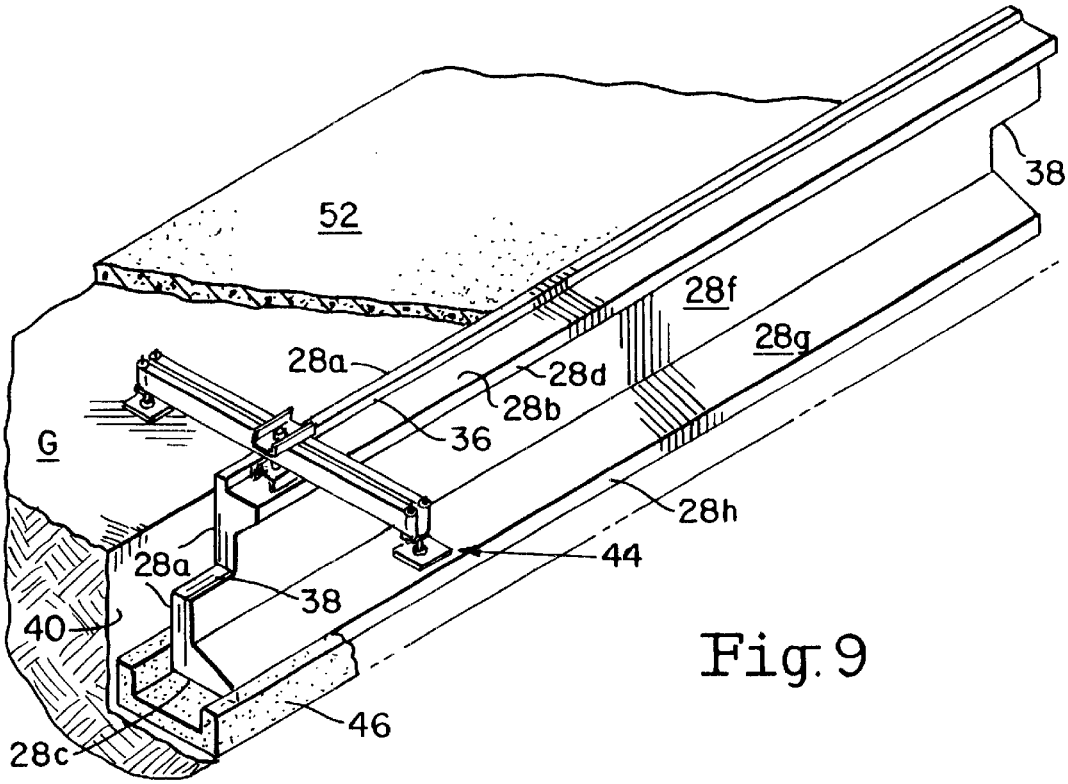
FIG. 9 is a schematic illustration of the installed beam element of this invention prior to removal of the suspension equipment.

After beam element 28 has been secured into place, a floor slab 52 can be cast, as shown in FIG. 8. During casting of the slab, the beam element will not vary as field forms tend to do under the pressure of concrete casting. Thus, beam element 28 can serve as a stay-in-place edge form during formation of the cast-in-place floor slab 52.

As stated previously herein, in preferred embodiments, beam element 28 further has disposed therein a notch 38 (FIG. 9) extending along the length of the beam element. Notch 38 can serve as a block edge to facilitate weathertight installation of a wall slab 54.

The precast concrete beam element of this invention can be made directly at the construction site by using a portable, ready-mix bulk plant. However, it is preferred to precast the beam elements at a remote fabrication location dedicated to that purpose and then transported to the construction site.

What is claimed is:

1. A precast structural beam element, comprising:

(i) a straight back face;

(ii) a top surface;

(iii) a bottom surface;

(iv) a front face; the front face having:

a first upper surface extending perpendicularly and downwardly from the top surface and being parallel to the back face;

a second upper surface which slopes downwardly and inwardly from the first upper surface;

a middle surface which is parallel to the back face and which extends downwardly from the second upper surface;

a first lower surface which slopes downwardly and outwardly from the middle surface; and a second lower surface which is parallel to the back face and which extends downwardly from the first lower surface and perpendicularly to the bottom surface; and (v) first and second opposite side faces disposed between the back and front faces and between the top and bottom surfaces, wherein the back face extends substantially vertically relative to the ground, and wherein the bottom surface extends substantially horizontally relative to the ground.

2. The beam element according to claim 1, wherein the middle surface of the front face has a dapped surface formed therein.

3. A beam element comprising:

(i) a straight back face;

(ii) a top surface;

(iii) a bottom surface;

(iv) a front face; the front face having:

a first upper surface extending perpendicularly and downwardly from the top surface and being parallel to the back face;

a second upper surface which slopes downwardly and inwardly from the first upper surface;

a middle surface which is parallel to the back face and which extends downwardly from the second upper surface;

a first lower surface which slopes downwardly and outwardly from the middle surface; and a second lower surface which is parallel to the back face and which extends downwardly from the first lower surface and perpendicularly to the bottom surface; and (v) first and second opposite side faces disposed between the back and front faces and between the top and bottom surfaces wherein the top surface of the beam element has a notch formed therein which extends lengthwise along the top surface.

4. A method of making a precast beam element, comprising:

(1) providing a mold comprising:

(a) a longitudinally movable lateral side rail having an inner wall for forming a top surface of the beam element;

(b) an opposite fixed lateral side rail having an inner wall for forming a bottom surface of the beam element;

(c) a first longitudinal side rail disposed between the movable and fixed lateral side rails and having an inner wall for forming a first side face of the beam element;

(d) an opposite second longitudinal side rail disposed between the movable and fixed lateral side rails and having an inner wall for forming a second side face of the beam element;

(e) an infill plate disposed between the inner walls of the lateral and longitudinal side rails such that an upper face of the infill plate and the inner walls of the lateral and longitudinal side rails define a mold cavity, the upper face of the infill plate being disposed to form a front face of the beam element, wherein the front face of the beam element includes a first surface and a second surface, wherein the first surface of the front face is not parallel to the second surface of the front face; and (f) one or more dowel rods projecting upwardly from the mold cavity;

(2) filling the mold cavity with a flowable fill material;

(3) allowing the flowable fill material to harden to form the beam element; and (4) removing the beam element from the mold cavity.

5. The method according to claim 4, wherein the inner surface of the longitudinally movable lateral side rail has a configuration so as to form a notch which extends lengthwise along the top surface of the beam element.

6. The method according to claim 4, wherein the flowable fill material includes concrete.

7. The method according to claim 4, wherein the upper face of the infill plate has a configuration so as to form a dapped surface in the middle surface of the front face.

8. A method for installing a precast beam element into the ground, comprising:

(1) providing an excavated trench having a bottom surface, inner wall surfaces and an open top surface;

(2) suspending the beam element above the trench so that a bottom gap is formed between a bottom face of the beam element and the bottom surface of the trench and a side gap is formed between the inner walls of the trench and front, back and side faces of the beam element;

(3) pouring a flowable fill material into the trench so as to fill the bottom gap and at least a portion of the side gap; and (4) causing the poured material to harden, wherein the beam element includes a load bearing portion.

9. The method according to claim 8, wherein the flowable fill material includes concrete or grout.

10. The method according to claim 8, wherein the top surface of the beam element has a notch formed therein which extends lengthwise along the top surface.

11. The method according to claim 8, further comprising installing a second beam element adjacent to the first mentioned beam element.

12. The method according to claim 8, wherein a middle surface of the front face of the beam element has a dapped surface formed therein.

13. A method for forming a floor slab, comprising:

(1) installing a precast beam element into the ground;

(2) providing a floor slab-forming location for forming the floor slab, the location being adjacent to the beam element such that a back face of the beam element will serve as an edge form during casting of the floor slab; and (3) casting the floor slab in said location, wherein the precast beam element includes:

(i) the straight back face;

(ii) a top surface;

(iii) a bottom surface;

(iv) a front face; the front face having:

a first upper surface extending perpendicularly and downwardly from the top surface and being parallel to the back face;

a second upper surface which slopes downwardly and inwardly from the first upper surface;

a middle surface which is parallel to the back face and which extends downwardly from the second upper surface;

a first lower surface which slopes downwardly and outwardly from the middle surface; and a second lower surface which is parallel to the back face and which extends downwardly from the first lower surface and perpendicularly to the bottom surface; and (v) first and second opposite side faces disposed between the back and front faces and between the top and bottom surfaces, wherein the back face extends substantially vertically relative to the ground, and wherein the bottom surface extends substantially horizontally relative to the ground.

14. The method according to claim 13, wherein the top surface of the beam element has a notch formed therein which extends lengthwise along the top surface.

15. The method according to claim 10, wherein the middle surface of a front face of the beam element has a dapped surface formed therein.

16. A method of forming a wall slab, comprising:

(1) installing a precast beam element into the ground;

(2) providing a wall slab-forming location for forming the wall slab, the location being adjacent to the beam element such that a top surface of the beam element will serve as an edge form during casting of the wall slab; and (3) casting the wall slab in said location.

wherein the precast beam element includes:

(i) a straight back face;

(ii) the top surface;

(iii) a bottom surface;

(iv) a front face; the front face having:

a first upper surface extending perpendicularly and downwardly from the top surface and being parallel to the back face;

a second upper surface which slopes downwardly and inwardly from the first upper surface;

a middle surface which is parallel to the back face and which extends downwardly from the second upper surface;

a first lower surface which slopes downwardly and outwardly from the middle surface; and a second lower surface which is parallel to the back face and which extends downwardly from the first lower surface and perpendicularly to the bottom surface; and (v) first and second opposite side faces disposed between the back and front faces and between the top and bottom surfaces, wherein the back face extends substantially vertically relative to the ground, and wherein the bottom surface extends substantially horizontally relative to the ground.

17. The method according to claim 16, wherein the top surface of the beam element has a notch formed therein which extends lengthwise along the top surface.

18. The method according to claim 16, wherein the middle surface of a front face of the beam element has a dapped surface formed therein.

* * * * *